US005561900A

United States Patent [19]

Hosler, Sr.

[11] Patent Number: 5,561,900

[45] Date of Patent: Oct. 8, 1996

[54] METHOD OF ATTACHING COAXIAL CONNECTOR TO COAXIAL CABLE

[75] Inventor: Robert C. Hosler, Sr., Marysville, Pa.

[73] Assignee: The Whitaker Corporation, Wilmington, Del.

[21] Appl. No.: 339,718

[22] Filed: Nov. 14, 1994

Related U.S. Application Data

[60] Division of Ser. No. 151,095, Nov. 12, 1993, Pat. No. 5,387,128, which is a continuation-in-part of Ser. No. 62,100, May 14, 1993, abandoned.

[51] Int. Cl.[6] ..... H01B 13/20

[52] U.S. Cl. ..... 29/828; 174/75 C

[58] Field of Search ..... 29/828, 869, 870, 29/871; 174/75 C

[56] References Cited

U.S. PATENT DOCUMENTS

| | | | |
|---|---|---|---|
| 2,786,095 | 3/1957 | Arbeiter | 29/828 X |
| 3,103,548 | 9/1963 | Concelman | 174/89 |
| 3,199,061 | 8/1965 | Johnson et al. . | |
| 3,291,895 | 12/1966 | Van Dyke | 174/88 |
| 3,701,086 | 10/1972 | Somerset | 174/75 C X |
| 3,958,818 | 5/1976 | Mason | 174/75 C |
| 4,046,451 | 9/1977 | Juds et al. . | |
| 4,047,291 | 9/1977 | Spinner . | |
| 4,400,050 | 8/1983 | Hayward . | |
| 4,444,454 | 4/1984 | Horowitz . | |
| 4,469,390 | 9/1984 | LeVine et al. . | |
| 4,491,685 | 1/1985 | Drew et al. | 174/75 C |
| 4,509,816 | 4/1985 | Freitag . | |
| 4,668,043 | 5/1987 | Saba et al. . | |
| 4,678,261 | 7/1987 | Mitani et al. | 439/582 |
| 4,687,272 | 8/1987 | Spinner et al. | 439/271 |
| 4,800,351 | 1/1989 | Rampalli et al. | 333/237 |
| 4,824,400 | 4/1989 | Spinner | 439/578 |
| 4,990,106 | 2/1991 | Szegda | 439/585 |
| 4,995,832 | 2/1991 | Thommen et al. | 439/578 |
| 5,073,129 | 12/1991 | Szegda | 439/585 |
| 5,120,260 | 6/1992 | Jackson | 439/585 |
| 5,137,470 | 8/1992 | Doles | 439/578 |
| 5,141,451 | 8/1992 | Down | 439/585 |
| 5,154,636 | 10/1992 | Vaccaro et al. | 439/583 |
| 5,167,533 | 12/1992 | Rauwolf | 439/583 |
| 5,267,877 | 12/1993 | Scannelli et al. | 439/584 |
| 5,322,454 | 6/1994 | Thommen | 439/584 |
| 5,334,051 | 8/1994 | Devine et al. | 439/583 |

FOREIGN PATENT DOCUMENTS

3842294A1 6/1990 Germany .

OTHER PUBLICATIONS

MIL-C-28830/CC Draft Military Specification Sheet dated Apr. 17, 1992, pp. 1 to 3; Defense Electronics Supply Center, Dayton, Ohio.

*Primary Examiner*—Carl J. Arbes
*Attorney, Agent, or Firm*—Anton P. Ness

[57] ABSTRACT

A coaxial connector (10) for a coaxial cable (100) having a corrugated outer conductor (108), including one which is helically corrugated. An adapter (40) of the connector can include a crimpable sleeve (44) within which is a bushing (70) initially having an axial slot (72) of selected dimension. The inner surface (74) of the bushing is fluted defining ridges and grooves (for cable of annular corrugation), or a continuous helical ridge (76) and associated groove (78) defining a thread of corresponding pitch, and general inner diameter permitting cable insertion. Upon full threading of the cable end into adapter (40), crimp sleeve (44) is crimped thus closing axial slot (72) and stopping the crimp process to achieve a minimum desired inner diameter. The adapter may be a discrete subassembly and securable to a forward connector portion in modular fashion by complementary threaded flanges (32,46). A connector (500) can also include one or more radial holes (514) extending to the cable-receiving region permitting solder (522) or conductive epoxy to be deposited following cable insertion, for mechanically and electrically connecting the rearward connector portion to the cable outer conductor (510) other than by crimping.

3 Claims, 10 Drawing Sheets

METHOD OF ATTACHING COAXIAL CONNECTOR TO COAXIAL CABLE

RELATED APPLICATION INFORMATION

This application is a division of application Ser. No. 08/151,095, filed Nov. 12, 1993 now U.S. Pat. No. 5,387,128 which is a continuation-in-part of Ser. No. 08/062,100, filed May 14, 1993, now abandoned.

FIELD OF THE INVENTION

The present invention is related to electrical connectors and more particularly to connectors for coaxial cable having a corrugated outer conductor.

BACKGROUND OF THE INVENTION

Generally coaxial cable includes an inner conductor surrounded by a layer of dielectric material and precisely centered within an outer conductor, and having an outer jacket of dielectric material. In certain coaxial cable, the outer conductor defines a ground return path necessary for microwave signal transmission, and is termed semirigid coaxial cable. In certain semirigid coaxial cable, the outer conductor is strengthened by corrugation, and in certain such cable the corrugation is helical, as is described in proposed draft Military Specification MIL-C-28830/AA. U.S. Pat. No. 5,154,636 discloses a connector for such cable includes a forward connector assembly with an inner contact disposed within a dielectric insert in an outer conductive housing, with the outer housing including a rearwardly extending threaded flange in which a flaring ring is disposed. A rear connector portion is assembled separately to the cable end, and comprises a clamping member having a threaded inner surface to match the helical corrugations of the outer cable conductor. The flaring ring has an inner diameter at least as small as the inside diameter of the helically corrugated outer cable conductor, and includes a bevelled end which engages the inner surface of the open end of the outer cable conductor to flare the engaged portion outwardly against a complementarily bevelled surface along the forward end of the clamping member, as the forward connector assembly is threaded onto the end of the clamping member. U.S. Pat. No. 5,137,470 discloses a similar connector.

Other connectors for coaxial cable with helically corrugated outer conductor are disclosed in U.S. Pat. Nos. 3,199,061; 4,047,291; 4,995,832 and 4,824,400. Additional connectors for coaxial cable having an annularly corrugated outer conductor are disclosed in U.S. Pat. Nos. 4,046,451 and 4,800,351.

It is desired to provide a coaxial connector for coaxial cable having a corrugated outer conductor which is easily assembled thereto and mechanically secured thereto.

It is further desired to provide such a connector which is easily assembled to the cable without deforming the outer conductor of the cable and which assures an electrical connection of the inner surface of the outer conductor with the outer conductive housing of the connector.

SUMMARY OF THE INVENTION

The present invention includes a connector having a forward or mating portion of standard or conventional configuration, and a rearward portion adapted to receive a prepared cable end thereinto. The rearward portion includes a bushing entrapped within a sleeve of the outer conductive housing of the connector and cooperatively receives the corrugated cable outer conductor thereinto for being either crimped thereagainst or soldered thereto to establish an assured ground connection therewith as well as a mechanical connection thereto. The bushing is initially C-shaped in cross-section which is manufactured to be disposed in the sleeve of selected inner diameter so that the axial slot is partially open to initially define a gap of selected spacing, with the bushing fabricated such that the general inner diameter after assembly within the sleeve is related closely to the general outer diameter of the cable outer conductor.

The interior surface is profiled into alternating ridges and grooves to match the corrugations of the outer conductor of the coaxial cable, and initially permits the cable end to easily be inserted thereinto until the inner conductor is matingly received into a socket contact section of the forward connector portion and the end of the cable's outer conductor abuts an annular interior flange of the sleeve. In a first embodiment, the sleeve is then crimped with crimp tooling against the bushing, urging the bushing against the corrugated cable outer conductor at least substantially closing the axial slot and compressing the ridges of both the cable conductor and the bushing into the opposing grooves of the other in an interference fit. The gap of the axial slot is precisely dimensioned to permit sufficient reduction in bushing inner diameter so that the general inner diameter of the bushing complements the outer diameter of the cable outer conductor to define a compression fit with controlled slight deformation of the outer conductor, with either the crimp tooling or ultimately the closing of the axial slot acting to control crimping to avoid deformation of the cable outer conductor into the underlying insulation. In another embodiment, the sleeve and bushing include one or more aligned apertures radially thereinto through which solder or conductive epoxy may be deposited to flow between the bushing inner surface and the cable outer conductor outer surface and harden or cure.

In a particular embodiment of the present invention for use with cable having a helically corrugated outer conductor, the interior surface of the bushing is threaded to have a pitch equivalent to the pitch of the helically corrugated outer conductor, and has a general inner diameter permitting the cable end to be threaded into the bushing without undue effort. The cable end is threaded into the bushing held within the sleeve until the inner conductor is matingly received into a socket contact section of the forward connector portion and the forward edge of the outer conductor abuts a rearwardly facing surface of an annular interior flange of the sleeve. This embodiment is useful with either the crimping or soldering approaches.

Where the connector is to be crimped onto the cable, the bushing's interior surface is profiled to define a helical ridge or thread and associated helical groove, with the profile precisely dimensioned to assure that upon crimping the surfaces defining the groove of the bushing abut and are compressed into the opposing surfaces of the ridge of the cable outer conductor, but the surfaces defining the ridge of the bushing does not engage the surfaces defining the groove of the cable outer conductor. Such arrangement assures that the bottom of the groove of the cable outer conductor is not engaged and deformed radially inwardly and into the insulative foam, while controllably deforming the ridge of the cable outer conductor to a limited extent to clinch the crest of the ridge which does not deform into the insulative foam and does not affect impedance of the cable. The leading edge of the outer conductor, which is initially urged tightly against the annular flange of the sleeve containing the bushing when threaded into the adapter, is pressed even more tightly thereagainst further enhancing the electrical connection of the inner surface of the outer conductor at a plurality of points about the circumference between the inner surface of the cable outer conductor and the connector outer conductive housing.

In one particularly useful form of the present invention, the forward connector portion is a subassembly including the inner contact within a dielectric housing, and the rear face of the portion includes a threaded annular flange. The rearward connector portion includes a forwardly extending annular flange complementarily threaded to be threaded onto the annular flange of the forward connector portion. Thus the rearward subassembly can be dimensioned to the specific size of the cable, while the forward subassembly can be one selected from several varieties thereof having standardized threaded flanges, in modular fashion. The modular arrangement permits utilization of the same rearward subassembly with a right angle forward connector configuration, for example, or one having a socket style or a pin style forward inner contact section as desired, or one having a circuit board mountable forward contact section.

It is an objective of the present invention to provide a coaxial connector suitable for use with semirigid coaxial cable of the type having corrugated outer conductor.

It is also an objective to provide such a connector for use with cable having a helically corrugated outer conductor.

It is additionally an objective to provide a coaxial connector crimpable to a corrugated cable outer conductor with only slight deformation of the cable outer conductor radially inwardly toward the inner conductor and yet establishing an assured mechanical and electrical connection.

It is also an objective to provide a coaxial connector which is solderable to a corrugated cable outer conductor to establish an assured mechanical and electrical connection.

It is a further objective to provide a cable-engaging connector portion which can be utilized in modular fashion with one of a variety of forward connector portions.

Embodiments of the present invention will now be described by way of example with reference to the accompanying drawings.

DETAILED DESCRIPTION OF THE PREFERRED EMBODIMENTS

Figure 1:
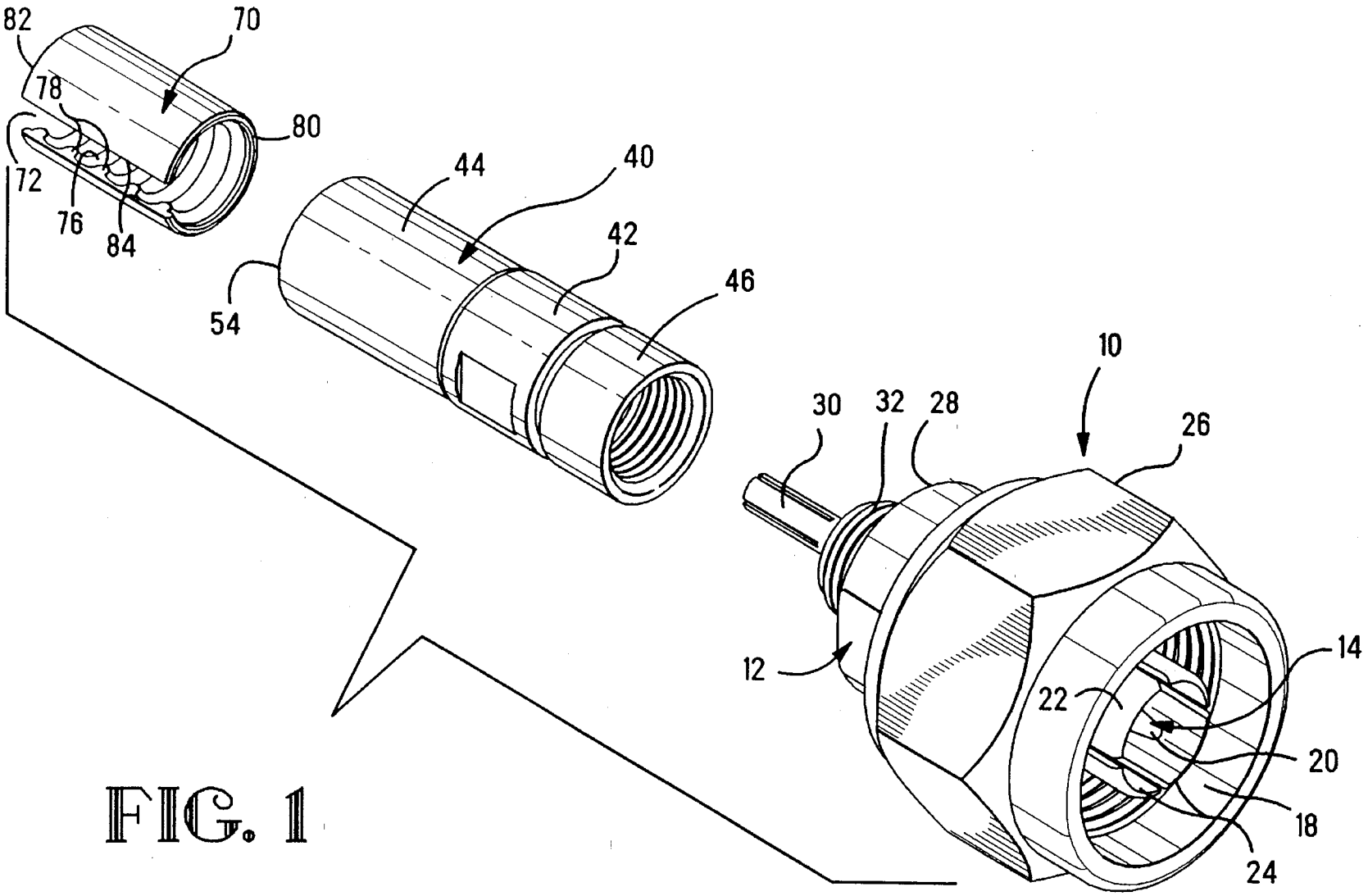
FIG. 1 is an isometric view of the coaxial cable connector of the present invention, with the bushing and adapter exploded from the forward connector assembly.
Figure 2:
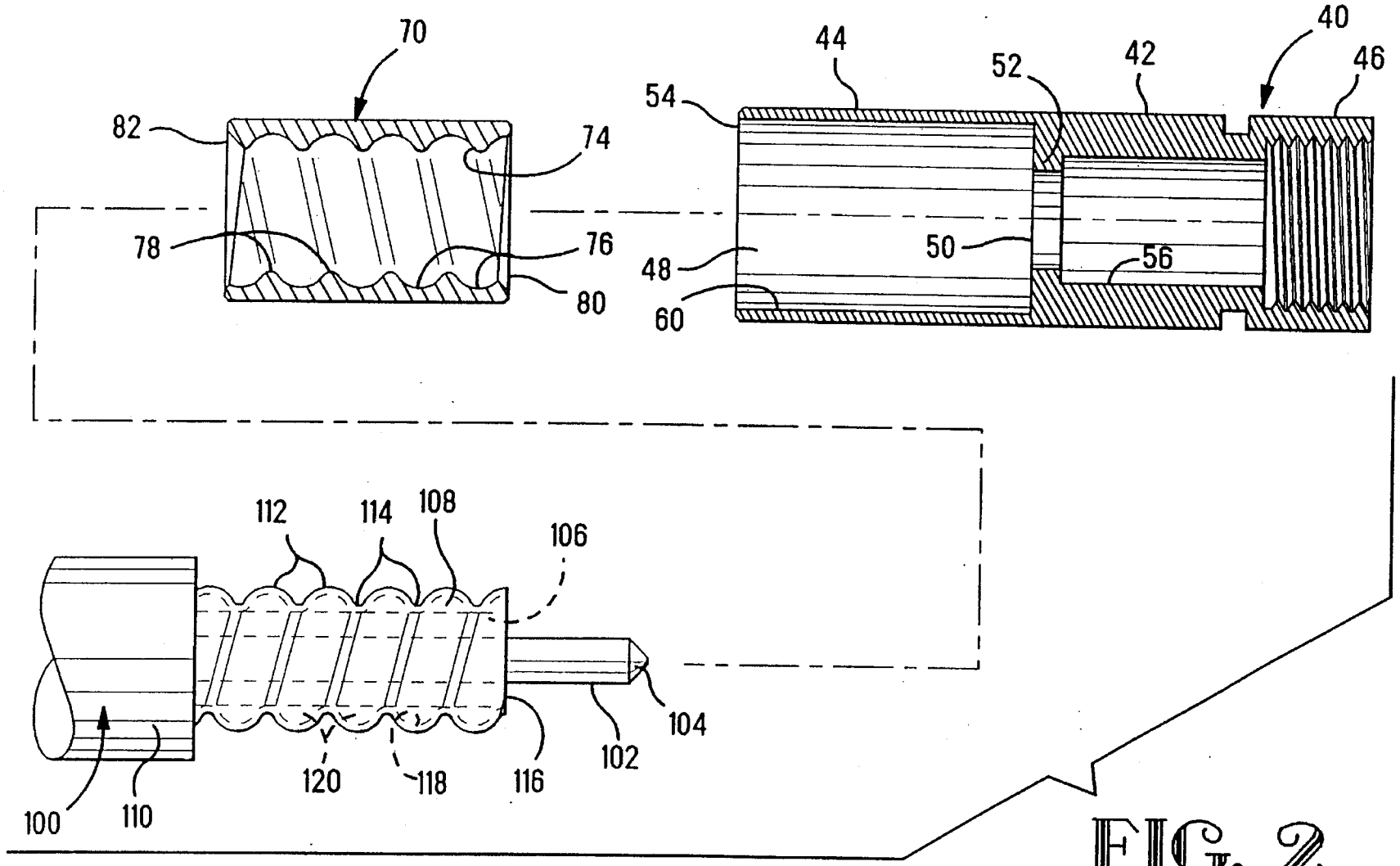
FIG. 2 is a longitudinal section view of the bushing and adapter of the connector of FIG. 1, with a prepared cable end to be inserted thereinto.
Figure 3:
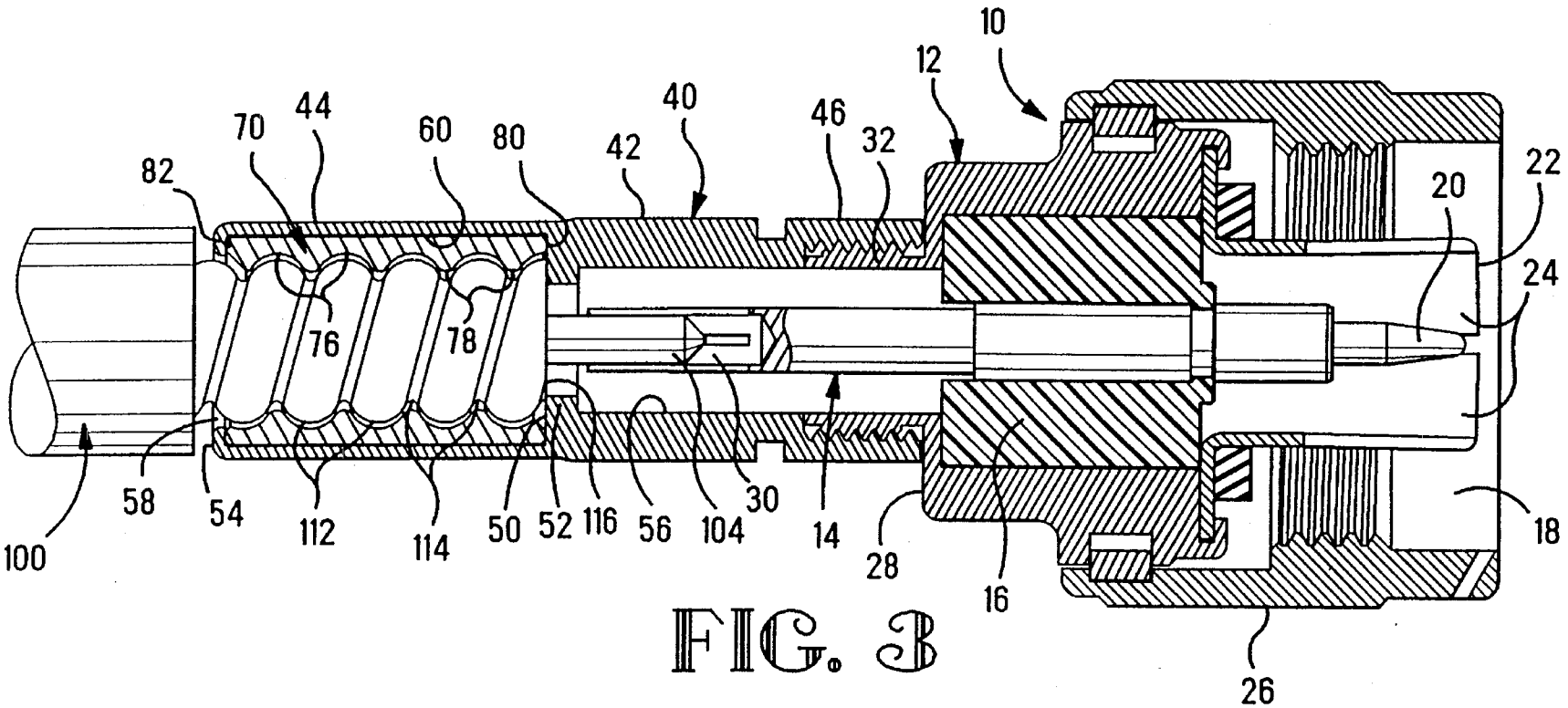
FIGS. 3 and 4 are longitudinal section views of the connector of FIG. 1 threaded onto the coaxial cable and then crimped onto the helically corrugated outer conductor, and with the adapter threadedly coupled to a flange of the forward connector assembly.

The coaxial connector of the present invention includes a forward connector portion and a rearward connector portion, with the rearward connector portion having a body section 42 and including a bushing 70 which will be disposed within a crimp sleeve portion 44 extending rearwardly from body portion 42. Preferably the rearward connector portion is a discrete adapter assembly 40, as shown in FIGS. 1 and 2, which is securable to a forward connector assembly 10 which enables modularity as will be described. Forward connector assembly 10 includes an outer conductive housing 12 and an inner conductor or contact 14 held coaxially therewithin by a dielectric insert 16 as shown in FIG. 3. Mating interface 18 of the connector is seen in FIG. 1 to include a pin contact section 20 coaxially surrounded by an outer contact section 22 defined by four cantilever spring arms 24. A coupling nut 26 is rotatably affixed to the outer conductive housing 12 and facilitates assured mating of the connector with a mating or complementary connector (see FIG. 8).

Extending rearwardly from an assembly face 28 of forward connector assembly 10 is a socket contact section 30 of inner contact 14 matable with the inner conductor of the cable. Outer conductive housing 12 includes an externally threaded flange 32 extending axially rearwardly from assembly face 28, cooperable with internally threaded flange 46 extending forwardly from body section 42 of adapter 40, enabling assured mechanical and grounding coupling of adapter 40 with forward connector assembly 10. Bushing 70 is shown to be a member C-shaped in cross-section initially having a defined axial slot 72 therealong with a gap of selected dimension. Bushing 70 has an internal surface 74 which is profiled to define parallel adjacent grooves 76 between ridges 78 of selected spacing at a slight angle from being orthogonal to the axial direction to define an approximate helical thread, and which when bushing 70 is compressed to at least substantially close gap 72, define a substantially continuous helical thread.

Referring to FIG. 2, cable 100 is shown to have an inner conductor 102 having an exposed section 104 extending from cable 100 preferably shaped to define a pin contact section matable with a socket contact. Inner conductor 102 is disposed within a dielectric sleeve 106 (in phantom), which maintains it coaxially within outer conductor 108 contained within an outer jacket 110. Outer conductor 108 comprises a corrugated shape having alternating ridges 112 and grooves 114 which as shown is a helical corrugation in which actually one continuous ridge is wound along the length thereof such as at a groove-to-groove spacing of about 0.105 inches, with the dimension between the crest of the rounded ridge and the groove bottom may be about 0.032 inches. The outer conductor extends to a leading edge 116 which is preferably orthogonal to the inner conductor. In such cable electrical current is carried adjacent inner surface 118 of outer conductor 108 which may have a thickness of about 0.008 inches. Spaces 120 defined along inner surface 118 inwardly of ridges 112 is air-filled surrounding insulative layer 106 which may be low loss foam polyethylene.

Adapter 40 is assembled by placing bushing 70 into large rearward cavity 48 until leading edge 80 abuts rearwardly facing surface 50 defined by annular interior flange 52. A rear edge portion of sleeve 44 is then inturned to form an inturned flange 54 along rear edge 82 of bushing 70, as seen in FIG. 3, which presses against rear bushing edge 82 and tightly secures bushing 70 between annular flange 52 and inturned sleeve portion 54. When adapter 40 is threaded onto forward connector assembly 10, socket contact section 30 is disposed within forward cavity 56 of body section 42. The entire connector assembly is ready to receive a prepared cable end thereinto for termination; alternatively, the adapter 40 may be applied to the cable end prior to securing adapter 40 to forward connector assembly 10.

The prepared cable end is threaded into the cable receiving rearward end 58 of adapter 40 until leading edge 116 of outer conductor 108 abuts against annular interior flange 52 and inner conductor pin section 104 becomes matingly engaged with socket contact section 32. Sleeve 44 is then crimped with crimping tool (not shown) in a manner similar to crimping procedures followed with other electrical connectors, which thus deforms sleeve 44 radially inwardly so that inner surface 60 of large cavity 48 is pressed against the outer surface of bushing 70 and compresses bushing 70 to a smaller diameter by closing gap 72 (FIG. 1). Crimp tooling includes dies which are closed to a fixed crimp diameter as is conventional with crimp tooling in general, to control the amount of crimp of the present invention to minimize deformation of the cable outer conductor; as an ultimate control on crimping, the gap along the axial slot of the bushing will stop the crimping procedure when facing edges 84 defining gap 72 abut stopping further deformation of sleeve 44.

Figure 4:
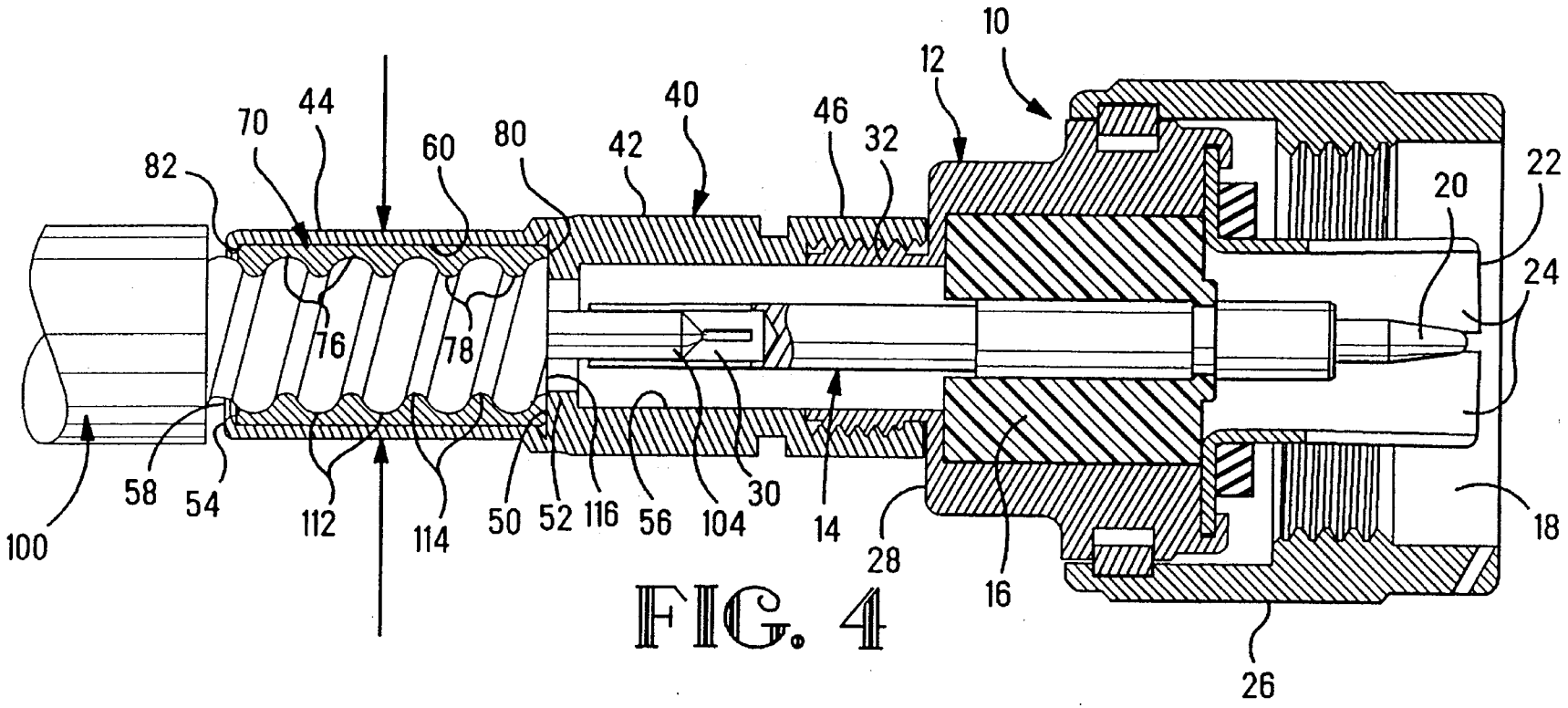

As a result, as seen in FIG. 4, inner surface 74 of bushing 70 is moved snugly against the outer surface of outer conductor 108 as ridges 78 move into grooves 114 and ridges 112 of outer conductor 108 are pressed into grooves 76 of bushing 70, without deforming the outer conductor radially inwardly but with compression clinching of ridges 112 therearound. The outer conductor will thereafter maintain a spring bias radially outwardly against the bushing's inner surface 74, providing a substantial frictional engagement between cable outer conductor 108 and bushing inner surface 74 preventing inadvertent unthreading of the cable end from the connector due to handling or to vibration during in-service use. Further, it is believed that the corners of edges 84 of gap 72 along inner surface 74 would tend to dig into cable outer conductor 108 to assist in preventing inadvertent unthreading. Cable 100 is thus firmly secured to adapter 40 and an assured electrical connection is established between inner conductor 102 and contact member 14 and between outer conductor 108 and annular flange 52 of adapter 40 and to outer conductive housing 12 of connector assembly 10.

Figure 5:
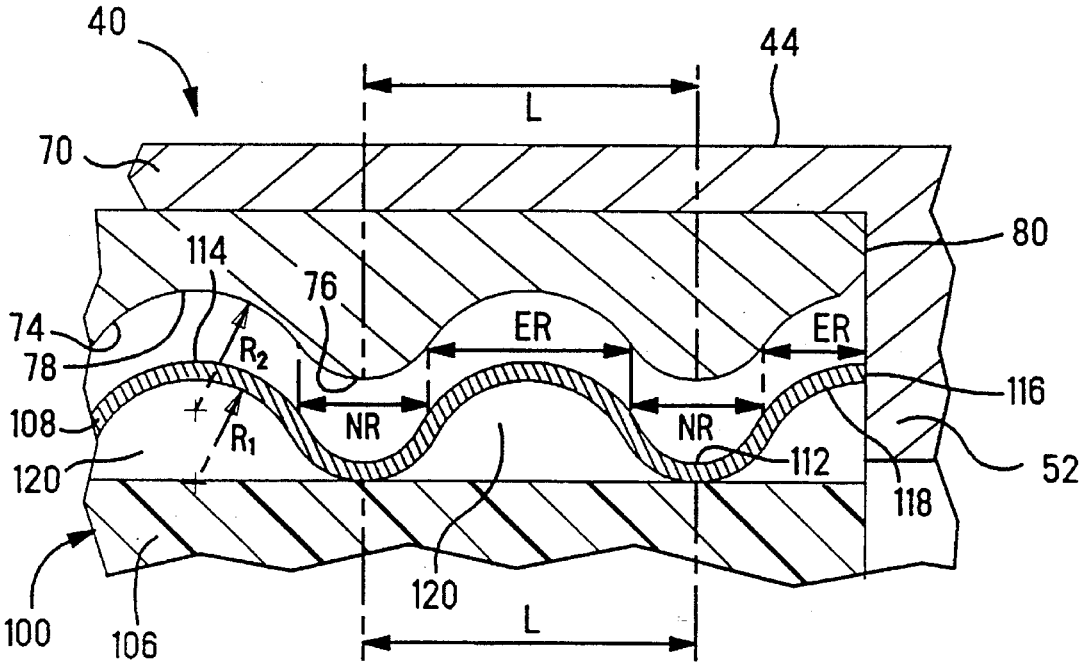
FIGS. 5 and 6 are enlarged partial longitudinal section views of the cable end and the bushing, with FIG. 5 being diagrammatical showing the relationship of the bushing profile and the cable outer conductor profile, and FIG. 6 illustrating the crimped condition.
Figure 6:
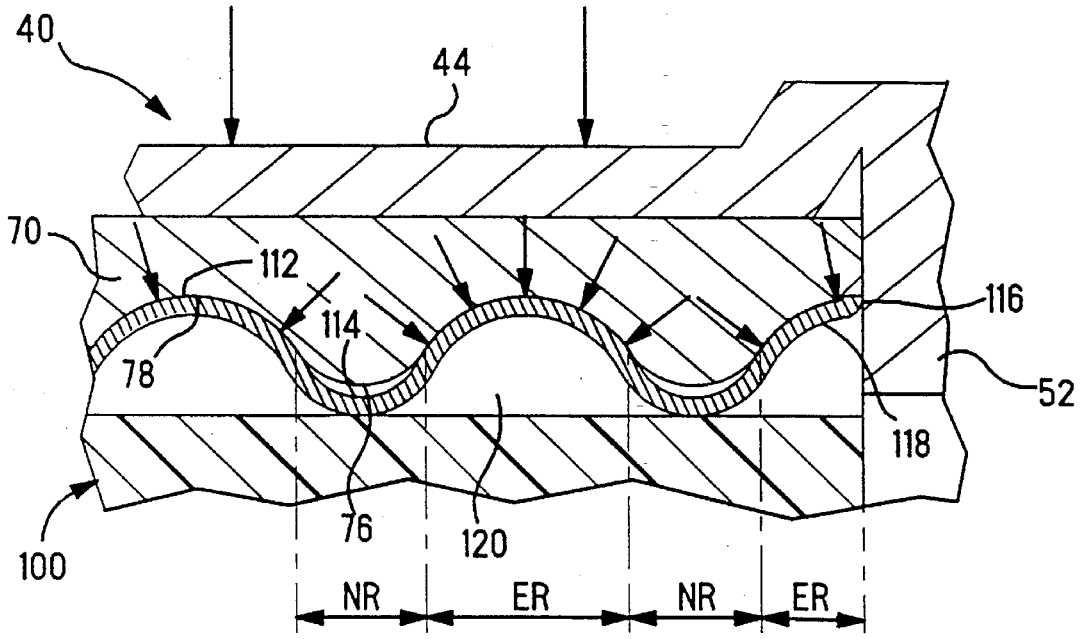

The profile of the bushing inner surface 74 and the cable outer conductor is illustrated in FIGS. 5 and 6. Preferably the crests of ridges 76 of the bushing have a lower "height" than the depth of the bottoms of corresponding grooves 114 of cable outer conductor 108, so that upon engagement of the groove bottoms 78 of the bushing with crests of ridges 112 of the cable outer conductor, the bushing crests 76 are spaced from the groove bottoms 114 of the cable outer conductor. The width of the axial slot 72 is selected so that in the crimped state the general inner diameter (along the crests) of the bushing is greater than the diameter of the cable outer conductor along the groove bottoms along the outwardly facing surface, thus acting to ultimately prevent overcrimping and radially inward deformation into the insulative layer 106.

Abutment of bushing and outer conductor preferably only occurs within the regions identified as ER or "engagement regions", and no engagement occurs in the regions identified as NR or "nonengagement regions". The precise dimensions of the bushing profile are selected to accommodate variations within manufacturing tolerance of the cable so that assured engagement occurs when the cable is at its smallest concerning outer diameter of the outer conductor and radius of the groove bottom 114, which are dimensions controlled by cable standards. The resultant radius $R_1$ of the ridge 112 of the outer conductor is at its largest within specification limits, and the radius $R_2$ of the bushing groove 78 must be selected to assure abutment and clinching along as much of the axial length of regions ER as possible. Clinching in these regions will incrementally deform the ridges of the cable outer conductor into air-filled spaces 120 but will not affect the controlled inner diameter of the cable outer conductor nor deform the insulative layer 106. Also such clinching along leading edge 116 of cable outer conductor 108 will urge the leading edge incrementally forwardly more tightly against annular flange 52 further enhancing compression of the inwardly facing surface 118 of the outer conductor thereagainst for much of the circumference of the leading edge. Such clinching or plastic deformation of annealed brass with essentially no spring properties deformed to press against the outer conductor, against the cable outer conductor with distinctly elastic deformation and therefore stored spring energy upon the adapter being crimped thereonto, produces a cold weld therebetween.

An example of adapter assembly 40 can include a member comprising body section 42, sleeve portion 44 and flange 46 is machined of half hard brass such as Alloy No. C36000 with the sleeve portion annealed to enhance the property of malleability achieving suitability for crimping, and then silver plated. Bushing 70 is formed and then machined of half hard brass, for example Alloy No. C36000, which is annealed, and then gold plated with the outer surface knurled. Both ends 80,82 are preferably chamfered along the outer and inner edges to facilitate insertion of either end into sleeve 44 and to facilitate receipt into either end of the leading edge 116 of cable outer conductor 108. To facilitate appropriate crimping, the outer surface of sleeve portion 44 includes a visible indicia axially therealong at the location overlying the axial slot of the bushing therewithin, to orient the adapter within the tool for the slot and indicia to be centered along the bottom of an arcuate crimping surface of one of the opposed crimping dies.

Standards for a 50 ohm cable of copper outer conductor, foam polyethylene insulative layer and copper-clad steel wire inner conductor, are a nominal outer diameter at the groove bottom of ±0.186 inches and permissible tolerance variation of ±0.005 inches, and at the ridge top of 0.250 inches ±0.005 inches; groove-to-groove spacing L of 0.105 inches and permissible tolerance variation of ±0.010 inches; and groove radius of 0.020 inches and permissible tolerance variation of ±0.005 inches; and outer conductor thickness of 0.008 inches ±0.0006 inches; and inner conductor diameter of 0.075 inches ±0.001 inches. A bushing 70 therefor can be machined to define a helical thread therethrough having a ridge crest radius of 0.032 inches, groove radius $R_2$ of 0.038 inches and depth of 0.023 inches, and an inner diameter before crimping of 0.224 inches; and then machined to have a slot width of about 0.100 inches, permitting an inner diameter after crimping of no less than about 0.191 inches with the slot closing at the outer bushing diameter. The resulting minimum inner bushing diameter thus is no less than the maximum permissible cable outer conductor diameter of 0.186+0.005 inches, or 0.191 inches.

Figure 7:
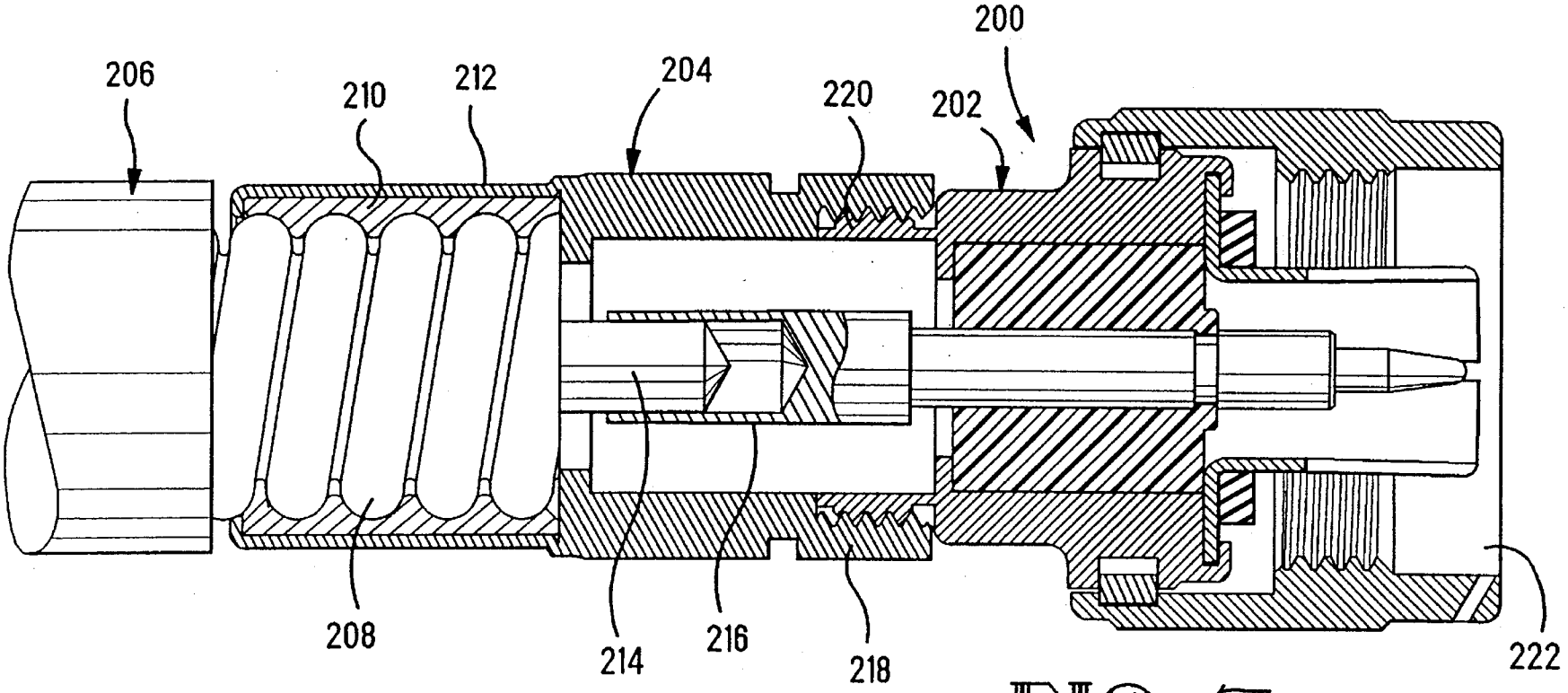
FIG. 7 is similar to FIG. 4 with an embodiment of connector for use with a larger diameter coaxial cable.

A second embodiment of coaxial connector is illustrated in FIG. 7 wherein connector assembly 200 has a forward connector assembly 202, adapter assembly 204 adapted for a cable 206. Cable 206 is shown to have a larger diameter relative to the mating face of the connector than cable 100 of FIGS. 1 to 4. Outer conductor 208 is larger in diameter, and bushing 210 and sleeve 212 of adapter 204 are correspondingly larger in diameter. Inner conductor 214 is larger in diameter, and socket contact section 216 is correspondingly larger. Internally threaded forward flange 218 of adapter assembly 204 is larger in diameter, as is externally threaded flange 220 of forward connector assembly 202. This embodiment maintains the same dimensions of mating interface 222 as mating interface 18 of the embodiment of FIGS. 1 to 4.

Figure 8:
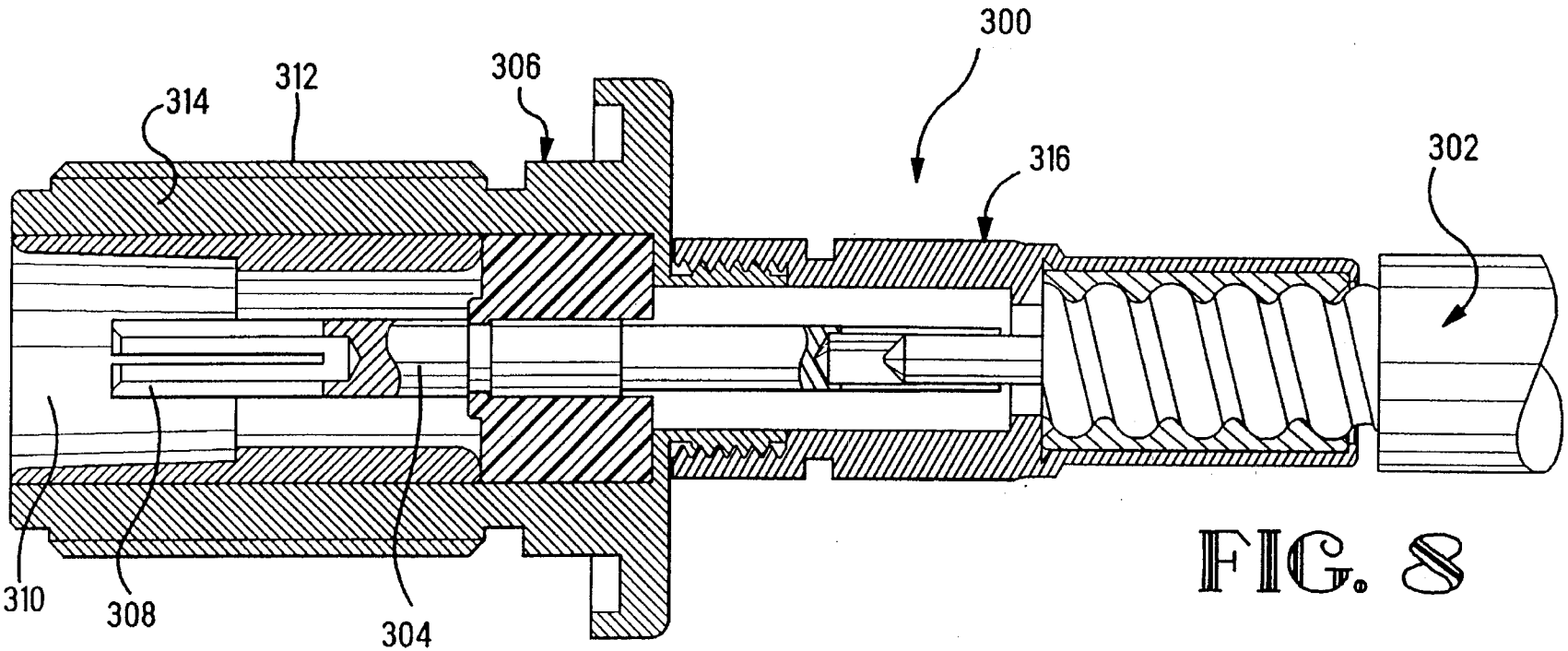
FIG. 8 is a longitudinal section view of another embodiment of connector applied to a coaxial cable, with the inner contact having a socket contact section and being matable to the connector of FIG. 4.

FIG. 8 illustrates an embodiment of coaxial connector 300 adapted for a cable 302 having the same dimensions as cable 100 of FIGS. 1 to 4, but wherein inner contact 304 within forward connector assembly 306 has a socket contact section 308 at the mating interface 310. The embodiment of connector 300 also includes a threaded surface 312 defined along the outer surface of the outer conductive housing 314. Connector 300 is thus adapted to be complementary to and matable with the coaxial connector 10. Adapter assembly 316 secured to forward connector assembly 306, however, is identical to adapter assembly 40 of FIGS. 1 to 4.

A right angle connector 400 is illustrated in FIG. 9, again using an adapter 402 identical to adapter assembly 40 of FIGS. 1 to 4, for use with a cable 404 having the same dimension as cable 100 thereof. Forward connector assembly 406 includes a right angle outer conductive housing 408 includes a tubular section 410 to which adapter assembly 402 is securable. The inner conductor is shown to comprise a first inner contact member 412 extending from the mating interface 414 around the right angle bend, to a second inner contact member 416 affixed to an inner end thereof, which concludes in the socket contact section 418 matable with the pin section of the cable inner conductor 420. A dielectric insert 422 is fabricated to contain the right angle inner contact assembly in appropriate centered position within the right angle outer conductive housing.

Figure 10:
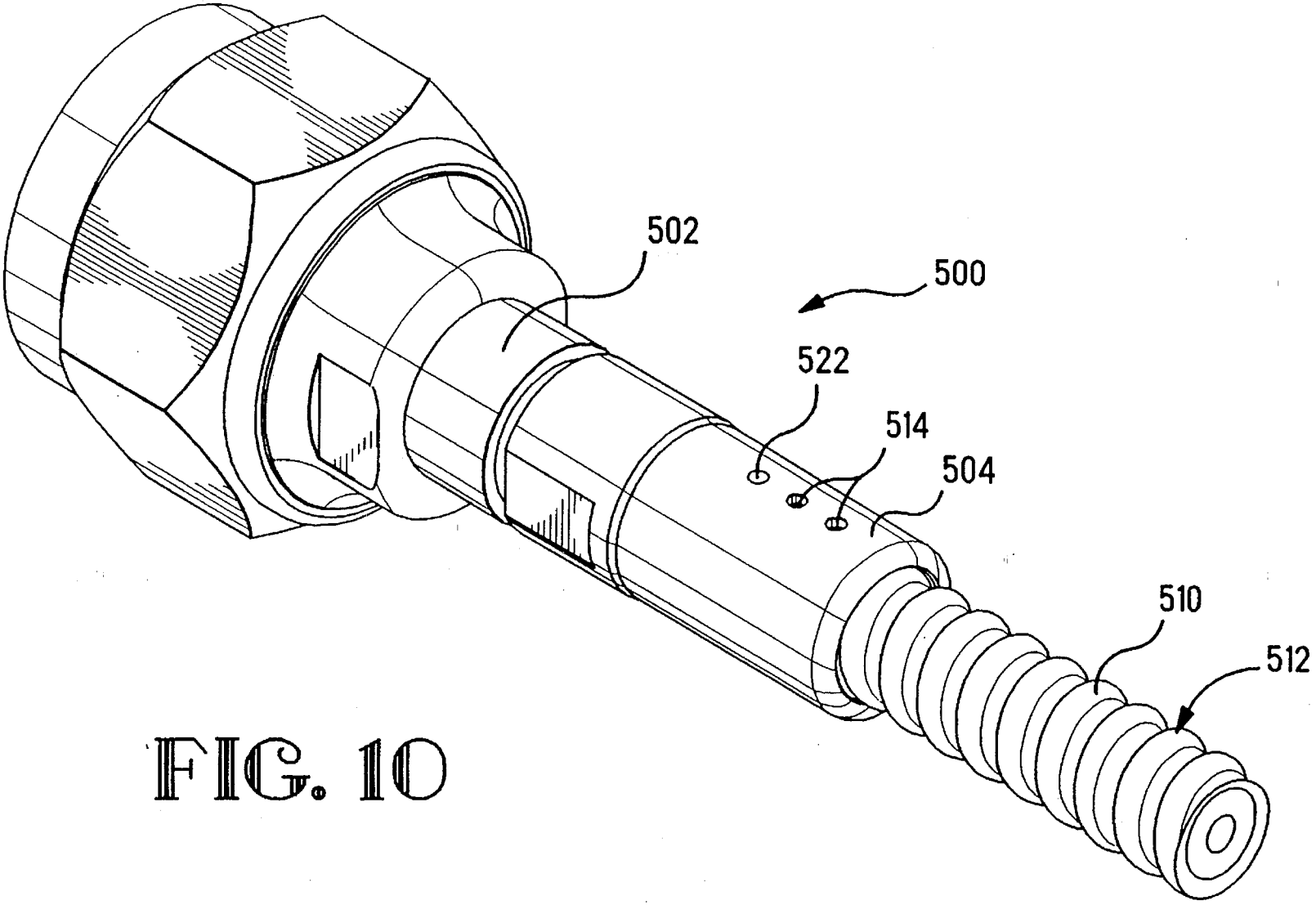
FIGS. 10 and 11 are isometric and sectional views of yet another connector embodiment for being joined to a coaxial cable by solder or conductive epoxy.
Figure 11:
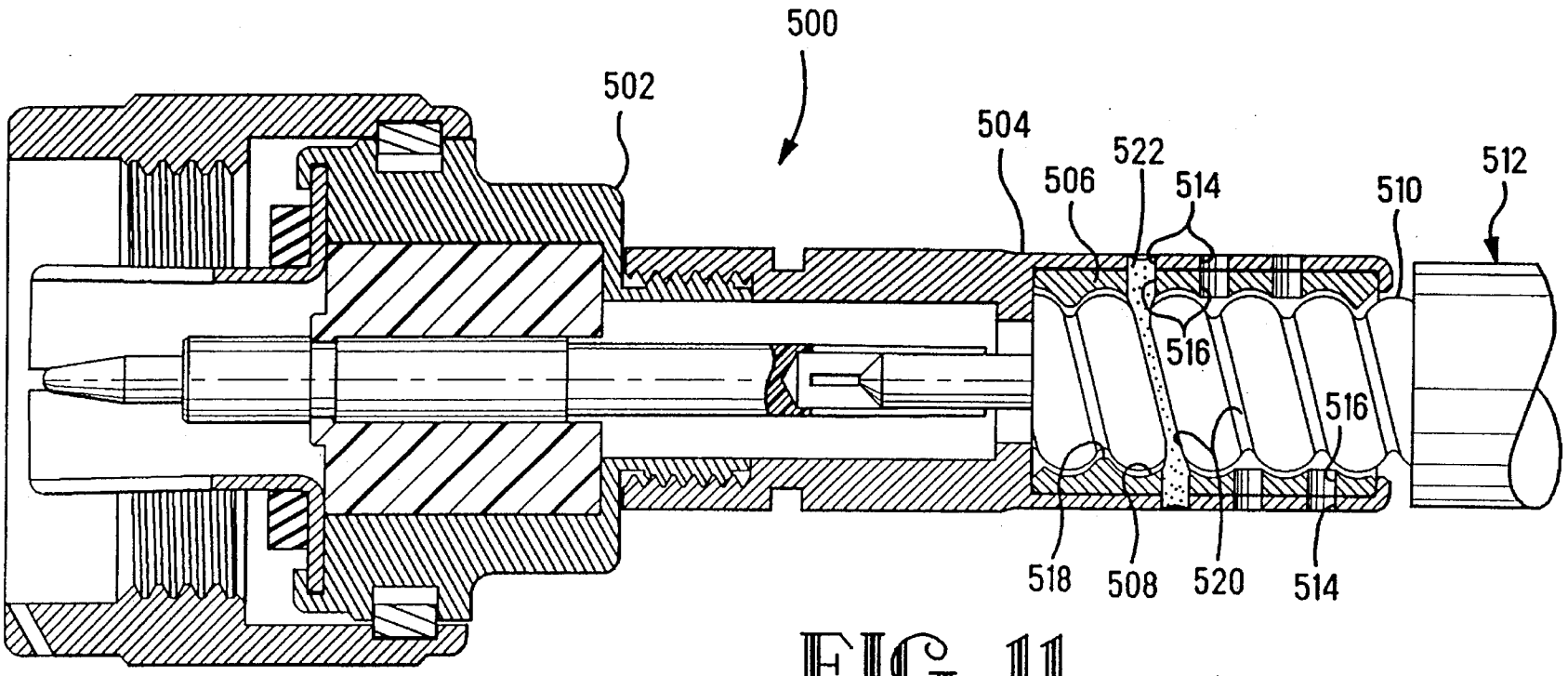

FIGS. 10 and 11 illustrate another embodiment of the coaxial connector of the present invention. Connector assembly 500 includes an outer shell 502 having a rearward sleeve 504 within which is disposed a bushing 506 having a helically threaded groove 508 complementary with the helically corrugated outer conductor 510 of coaxial cable 512. Solder-receiving holes 514 are seen through the rearward sleeve 504 and are aligned with solder-receiving holes 516 through bushing 506 to intersect a respective ridge 518 and thus conclude at a complementary groove 520 of the cable outer conductor 510. Solder 522 can be flowed through holes 514,516 and reflowed around the cable outer conductor 510 following groove 520 and solidifying therein to define a solder joint joining bushing 506 and cable outer conductor 510. Solder 522 may be of the type reflowable at low temperature such as 93° C., such as Ostalloy No. 200 sold by Arconium Specialty Alloys, Providence, Rhode Island, having 44% indium, 42% tin and 14% cadmium. Alternatively conductive epoxy may be used in lieu of solder, such as EPO-TEK H20E silver epoxy sold by Epoxy Technology, Inc., Billerica, Mass. dispensable by syringes and which is said to cure at 80° C. for 90 minutes.

Figure 9:
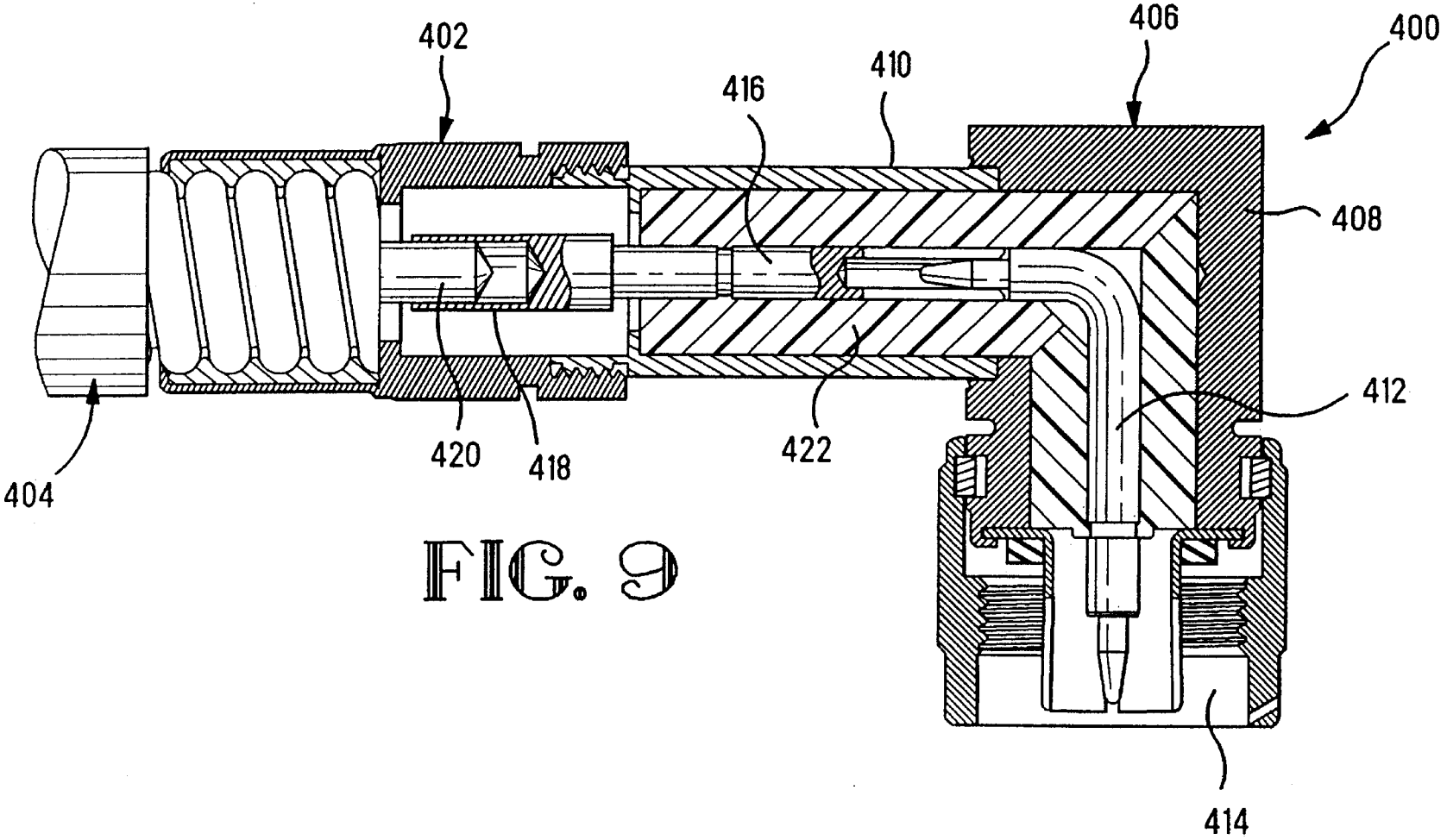
FIG. 9 is a view similar to FIG. 4 of another connector embodiment, with the forward connector assembly being a right angle connector.

The present invention can comprise an adapter section of a unitary outer conductive housing of a coaxial connector, and including a sleeve section within which a bushing is disposed and crimpable to a prepared coaxial cable end. The embodiments of FIGS. 8 and 9 are illustrative of the benefits of the modular nature of the adapter assembly of the present invention, when it is embodied in the form of a discrete adapter assembly rather than an integral part of an outer conductive housing of the connector.

Other variations and modifications can occur to the artisan and are within the spirit of the invention and the scope of the claims.

What is claimed is:

1. A method of attaching a connector assembly and a coaxial cable having an inner conductor and a corrugated outer conductor, said method comprising:

attaching the end of the inner conductor of the coaxial cable to a center connector of the connector assembly, threading onto the corrugated outer conductor of said cable, an outer connector having a threaded inside surface, the inside wall of said outer connector forming a circumferential shoulder which extends radially inwardly along the end of the corrugated outer conductor of the cable so that said shoulder is pressed into engagement with the end of said outer conductor to make electrical contact therewith, and crimping at least a portion of said threaded portion of said outer connector into the corrugations of said outer conductor.

2. A method of attaching a connector assembly and a coaxial cable having an inner conductor and a corrugated outer conductor, said method comprising:

(a) providing a connector assembly having a center connector and an outer connector having a threaded inside surface;

(b) providing a coaxial cable having an inner conductor and a corrugated outer conductor;

(c) attaching an end of said inner conductor of said coaxial cable to said center connector of the connector assembly;

(d) threading onto said corrugated outer conductor of said cable, said outer connector; and (e) crimping at least a portion of said threaded portion of said outer connector into the corrugations of said outer conductor.

3. The method of claim 2, further including the step of forming providing a circumferential shoulder at the inside wall of said outer connector which extends radially inwardly along the end of said corrugated outer conductor of said cable so that said shoulder is pressed into engagement with the end of said outer conductor to make electrical contact therewith.

* * * * *